United States Patent [19]

Flatland

[11] 4,378,745

[45] Apr. 5, 1983

[54] METHOD AND FURNACE FOR INCINERATION OF SOLID AND LIQUID WASTE

[75] Inventor: Torkjell Flatland, Notodden, Norway

[73] Assignee: Norsk Hydro A.S., Oslo, Norway

[21] Appl. No.: 162,794

[22] Filed: Jun. 25, 1980

[30] Foreign Application Priority Data

Jul. 5, 1979 [NO] Norway ..... 792236

[51] Int. Cl.[3] ..... F23G 5/12

[52] U.S. Cl. ..... 110/346; 110/211; 110/213; 110/214; 110/216

[58] Field of Search ..... 110/211, 213, 346, 235, 110/214, 216, 254, 264

[56] References Cited

U.S. PATENT DOCUMENTS 3,808,619 5/1974 Vanderveer ..... 110/213
4,063,521 12/1977 Pech ..... 110/213 X
4,177,740 12/1979 Lamb et al. ..... 110/213

*Primary Examiner*—Edward G. Favors
*Attorney, Agent, or Firm*—Wenderoth, Lind & Ponack

[57] ABSTRACT

An incinerator includes primary and secondary combustion zones, the two zones being connected via an intermediate section having an interior in the form of a restricted annular space. The inner surface of the annular space is perforated, and secondary combustion air is introduced into the annular space through these perforations, whereby combustion gases and air under violent rotation expand into an enlarged secondary combustion zone.

8 Claims, 3 Drawing Figures

METHOD AND FURNACE FOR INCINERATION OF SOLID AND LIQUID WASTE

BACKGROUND OF THE INVENTION

This invention relates to a new principle of incineration, a method for carrying out complete combustion of solid and liquid waste, and a furnace or a combustion plant utilizing the incineration principle.

The invention is suitable for the incineration and destruction of waste of any sort, solid or liquid and even so-called problem waste, such as plastic waste and waste from hospitals.

For combustion plants which do not work in association with specific gas cleaning units, which purify the flue gases before they are introduced into the atmosphere, it is important that the process of combustion proceeds under optimum conditions and that non-combustible particles, dust, ash, etc. are removed effectively within the combustion zone and are not carried out and emitted into the air together with the flue gases.

To keep air contaminations at a minimum, it is thus a main object with a combustion plant of this type to establish the highest possible complete combustion of the waste at the same time as all solid and non-combustible particles are separated, whereby essentially clean flue gases are emitted. It is common knowledge that satisfactory combustion cannot be obtained in only one combustion zone. Thus combustion in several combustion chambers is already utilized, where part of the combustion is conducted in a primary combustion zone and secondary combustion is conducted in subsequent combustion zones.

This combustion principle is for example used in the incinerator shown in Swiss Pat. No. 430018. The incinerator is equipped with a combustion chamber without grates and it has an inner wall of refractory material. By means of a vertical, perforated partition the furnace is divided into a primary combustion chamber and a secondary combustion chamber. Combustion air is led into the furnace from the outer walls of the furnace through a number of air jets situated at different heights and supplied with air from air tubes embedded in the brickwork of the furnace. Any necessary additional heat needed for combustion is provided by a burner which is situated outside the primary combustion chamber. Preferably a cyclone burner, placed at a distance above the bottom of the combustion chamber is utilized for this purpose.

However, this known equipment has several disadvantages. Firstly, a satisfactory degree of combustion will not be obtained with this construction. The secondary air from the air jets in the furnace walls is not satisfactorily mixed with the gaseous combustion products which move in layered streams into the secondary combustion chamber. Furthermore, the accompanying unburned solid particles will not be separated from the flue gases, whereby they are emitted into the air together with the flue gases.

To improve the degree of combustion an extra burner should also be provided in the secondary combustion chamber, and this is for example proposed according to the furnace construction described in Norwegian Pat. No. 125606. This will to a certain extent increase the efficiency of the secondary combustion, but still it will be unsatisfactory.

In performing practical combustion tests it has been experienced that the viscous, gaseous combustion products from the primary combustion hardly mix at all with the secondary combustion air. Thus, it is necessary to ensure a much stronger and more intense mixing effect, utilizing far greater mixing forces than has so far been generated within a combustion chamber.

SUMMARY OF THE INVENTION

Thus, it is a main object of the invention to provide a new and improved method of incineration which secures a complete combustion, at the same time as dust and other non-combustible particles are effectively separated from the flue gases emitted into the atmosphere.

This object is according to the invention provided by a method of incineration where the products of combustion from the primary combustion zone are led through a restricted, annular zone and given a rotating movement by simultaneously introducing additional combustion air under pressure from the inner surface of the annular zone. Subsequently, the combustion gases and the air are allowed to expand into an enlarged secondary combustion zone. The resulting heat expansion with simultaneous rotation creates a strong cyclonic movement effectively mixing unburnt gases and air, thus securing complete combustion of all combustible particles and products, at the same time as solid, incombustable particles are separated by centrifugal force.

The invention further relates to incinerators and combustion plants utilizing this special principle of incineration. The essential and characteristic features of these will be explained in the description following below, as well as in the drawings and the accompanying claims.

DETAILED DESCRIPTION OF THE DRAWINGS

Figures 1, 2, 3:
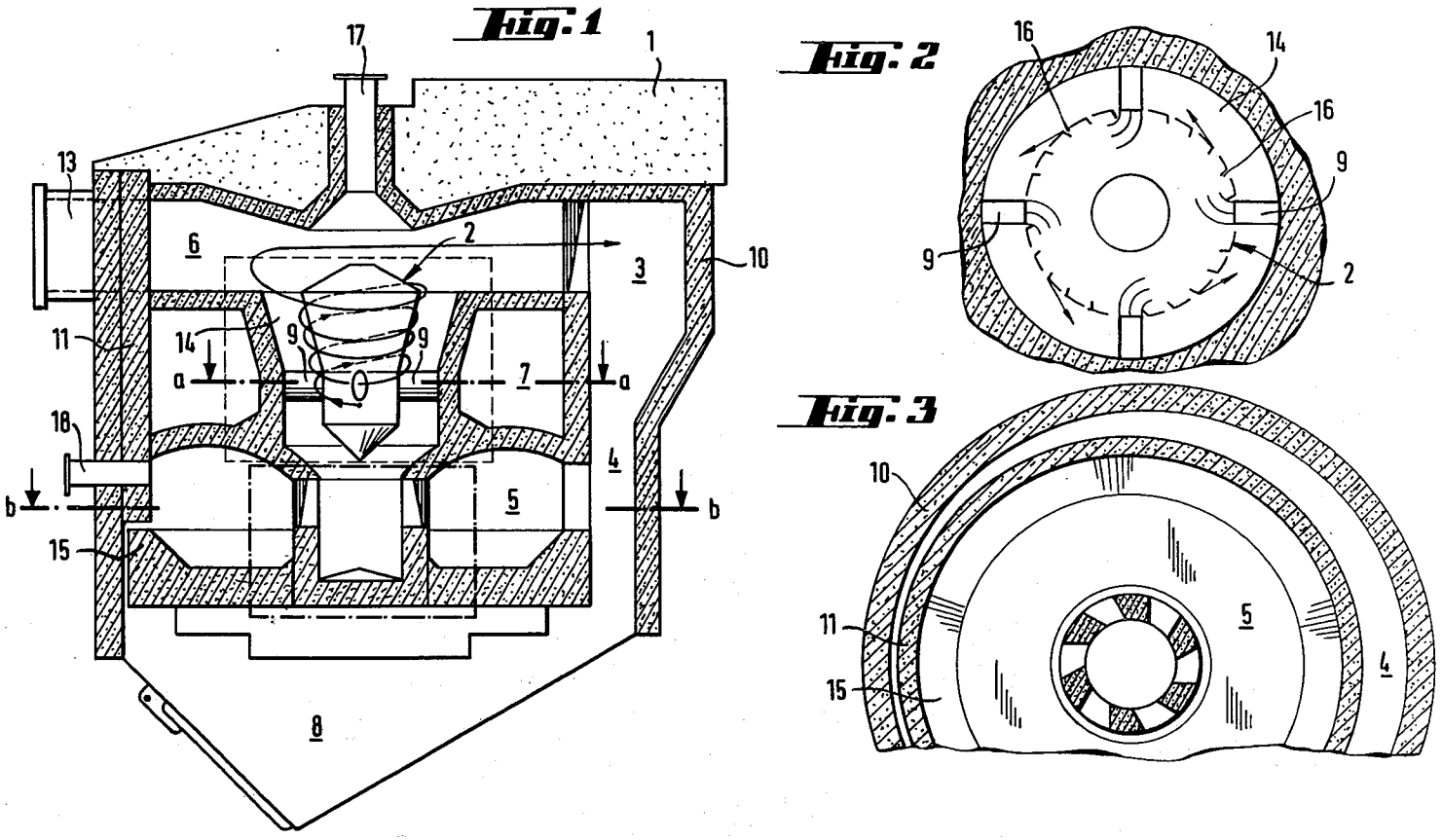
FIG. 1 is a schematic vertical sectional view of a incinerator where the principle according to the invention is employed.
FIG. 2 is a horizontal sectional view through the incinerator along the line a—a in FIG. 1 through a restricted, annular intermediate section which connects the primary combustion chamber to the secondary combustion chamber.
FIG. 3 is a horizontal sectional view through the incinerator along the line b—b on FIG. 1, through the primary combustion chamber of the incinerator.

The incinerator shown in FIGS. 1–3 is a continuous furnace with a rotating grate. It is especially designed for the combustion of household waste in municipal combustion plants. To make the presentation easier, details which are not essential to understand the combustion principle are removed. The incinerator consists of an outer casing 10 and an inner mantle or wall 11 made from stones of refractory material. The furnace is divided into a primary combustion chamber 5 with rotating grate 15 and a secondary combustion chamber 6. Between the primary combustion chamber 5 and the secondary combustion chamber 6 a specially designed intermediate section is provided which forms the inventive part of the incinerator. In the middle of this section is placed a hollow, central part 2, which defines the inner surface of a restricted annular space 14 between the two main parts, i.e. the primary combustion chamber 5 and the secondary combustion chamber 6. The hollow central part 2 is provided with a number of holes or perforations 16 which preferably are running tangentially in relation to the restricted annular space which is formed between the central part 2 and the inner furnace wall. The hollow, central part 2 is by means of special tubes or pipes 9 connected to a source (not shown on the drawing) from where additional combustion air under pressure is supplied.

Secondary combustion air under pressure is thus led into the annular space 14 through openings 16 in the central part 2, thus forming strong air streams. As these openings run tangentially in relation to the inner surface area of the annular, restricted passage or annular space 14, this will give the gas stream a tangential impulse or force, the size of which will be dependent on the pressure selected and/or the amount of the secondary air introduced. This will establish a rotating movement for the rising gas stream from the primary combustion chamber. In addition special baffles may also be employed to create such rotating movement.

The annular space 14 extends directly into the enlarged secondary combustion chamber 6. Due to the dimensions of the annular space, there will be created a more violent turbulence than in an ordinary venturi, and a strongly improved mixing of secondary air and combustion gases from the primary combustion zone will thus be obtained.

Larger non-combustible particles will, as is schematically shown for one single particle (traced) in FIG. 1, due to the centrifugal force created by gas rotation, be thrown out against the wall at the same time as they are led upwards. When the vertical component of velocity is decreased sufficiently, the particle will fall down. Remaining non combustible particles, fly dust and the like will thus be led out into a special ash-shaft 3 and from there will fall down into an ash-pit 8 via a downpipe or passage 4. The flue gases are led through a gas outlet 13. A secondary oil burner 17 is placed at the top of the secondary combustion chamber 6, while another burner 18, for the primary combustion chamber, is placed at one side of the chamber above the grate 15.

As outlined above, in the primary combustion chamber there is only a partial, pyrolytic combustion and the combustion gas mixture which is led to the secondary combustion chamber, contains burnable gases, for example CO and other volatile parts which are evaporated. This is obtained by limiting the amount of primary air so that a deficiency of oxygen is used in the primary combustion chamber.

EXAMPLE:

Waste was added every 15 minutes. Fuel oil was added through the burners both in the primary and in the secondary combustion zones. Measurements were taken of $O_2$ and temperature in the primary zone, of $O_2$, temperature and amount of dust and soot in the flue channel and of incinerated amounts of dust and consumption of oil. The amount of flue gases were measured with a pitot tube in the flue gas channel. From time to time the vacuum pressure in the primary zone and in the flue gas channel was registered. The furnace's registering instruments for temperature in the primary and secondary zones and in the flue gas channel were read.

The amount of waste incinerated was approximately 40 kg per 15 minutes, altogether approximately 165 kg/h. The oil was added from an oil barrel where the height was measured before and after combustion. The average consumption of oil was approximately 24 kg/h.

The dust concentration was measured according to a $CO_2$ content in the flue gas of 7%, that means an air excess coefficient number N=3. The concentrations measured were very low:

| | |
|---|---|
| Maximum | 79 mg/Nm$^3$ |
| Minimum | 53 mg/Nm$^3$ |
| Average value | 66 mg/Nm$^3$ |

For comparison it may be mentioned that the official Swedish and West-German emission requirements, which are among the strictest in the world are 175 and 200 mg/Nm$^3$ by 7% $CO_2$, respectively. The requirements are thus satisfied with a very clear margin and the degree of combustion may be characterized from very good to exceptional.

The invention is described above in connection with a continuously working incinerator with a rotating grate arrangement, especially designed for household waste. The principle of incineration may, however, also be utilized in connection with other types of incinerators for the combustion of solid as well as liquid waste.

For the combustion of for example problem waste from hospitals, an incinerator with horizontally separated combustion chambers of the type which is described in above mentioned Swiss Pat. No. 430018 is well suited. Such an incinerator may consist of a primary combustion chamber with a volume of from 2,000 to 4,000 liters made up from bricks of refractory materials and with burner equipment for pyrolytic combustion in the primary combustion chamber. The combustion air is introduced into the furnace through a system of jets supplied with air from a fan installation with a capacity of approximately 1,250 Nm$^3$, primary air. The horizontally separated secondary combustion chamber is also made up from bricks of refractory material and is equipped with an oil burner providing necessary heat to maintain a minimum temperature in the secondary combustion chamber. The furnace is thus equipped with both a primary and a secondary oil burner which is automatically switched on if the heat of combustion of the waste is not satisfactory to keep the temperatures within chosen minimum limits. Suitable temperature intervals may in this connection be from 1,100° to 1,400° C. in the primary combustion zone and from 1,000° to 1,200° C. in the secondary combustion zone.

Before the gas mixture is led into the horizontally separated secondary combustion chamber, it has to be led through an annular space according to the invention, where it is deflected to a horizontally rotating movement at the same time as air is blown through the openings in the inner surface of the annular space. The streams of air are blown out tangentially and with high velocity to secure a violent turbulence. Hereby is obtained a very efficient final combustion in the secondary combustion chamber, even if this chamber is situated at a distance away from the primary combustion chamber. The construction of this special annular space may be carried out the same way as in the example shown on FIGS. 1 to 3, with the provision of a hollow central part in a specially designed intermediate section of the furnace.

I claim:

1. A method for the incineration of solid and liquid waste, said method comprising:

providing a primary combustion zone, a secondary combustion zone, and a restricted annular space extending from said primary combustion zone to said secondary combustion zone, with the area of said annular space being less than the areas of said primary and secondary combustion zones, and with said annular space having an inner surface defined by a substantially cylindrical central member having a height greater than its diameter;

conducting primary combustion of waste in said primary combustion zone, thereby generating products of combustion including unburned combustibles and incombustible particles;

passing said products of combustion from said primary combustion zone, smoothly through said annular space, toward said secondary combustion zone;

introducing secondary combustion air, in a quantity sufficient to achieve complete combustion of said unburned combustibles, into said annular space in the form of high velocity air jets from a plurality of openings in said central member;

introducing said secondary combustion air and said products of combustion into said secondary combustion zone under conditions of violent rotation and expansion, and thereby achieving mixing of said secondary combustion air and said unburned combustibles in said secondary combustion zone, and causing said incombustible particles to be thrown outwardly through an outlet and discharged from said secondary combustion zone;

conducting secondary combustion of said unburned combustibles in said secondary combustion zone; and collecting said discharged incombustible particles in an ash pit separate from said combustion zones.

2. A method as claimed in claim 1, wherein said plurality of openings in said central member extend substantially tangentially of said annular space, and said step of introducing said secondary combustion air into said annular space comprises directing said high velocity air jets tangentially into said annular space, thereby imparting a rotating movement to said products of combustion and said secondary combustion air.

3. An incinerator for the incineration of solid and liquid waste, said incinerator comprising:

a primary combustion zone for the primary combustion therein of waste and for the generation of products of combustion including unburned combustibles and incombustible particles;

a secondary combustion zone for the secondary combustion therein of said unburned combustibles;

a restricted annular space within an intermediate zone extending from said primary combustion zone to said secondary combustion zone for passing said products of combustion from said primary combustion zone to said secondary combustion zone, said annular space having an inner surface defined by a substantially cylindrical central member having a height greater than its diameter, the area of said annular space being less than the areas of said primary and secondary combustion zones;

a plurality of opening means in said central member for introducing into said annular space secondary combustion air, in a quantity sufficient to achieve combustion of said unburned combustibles, in the form of high velocity air jets, thereby for causing said secondary combustion air and said products of combustion to be introduced into said secondary combustion zone under conditions of violent rotation and expansion, and thus for achieving mixing of said secondary combustion air and said unburned combustibles in said secondary combustion zone and causing said incombustible particles to be thrown outwardly; and outlet means in said secondary combustion zone for receiving said outwardly thrown incombustible particles and for discharging said incombustible particles outwardly from said secondary combustion zone.

4. An incinerator as claimed in claim 3, wherein said central member is hollow.

5. An incinerator as claimed in claim 3, wherein said opening means in said central member extend substantially tangentially of said annular space, for thereby directing said high velocity air jets tangentially into said annular space and imparting a rotating movement to said products of combustion and said secondary combustion air.

6. An incinerator as claimed in claim 3, wherein said secondary combustion zone expands outwardly in size from the entrance thereinto of said annular space.

7. An incinerator as claimed in claim 3, further comprising passage means for receiving said discharged incombustible particles from said outlet means and for directing said incombustible particles to an ash pit separate from said combustion zones.

8. An incinerator as claimed in claim 3, wherein said central member has a bottom portion with inclined surfaces for facilitating the passage of said products of combustion into said annular space.

* * * * *